US012158322B2

(12) United States Patent
Shipley, III et al.

(10) Patent No.: US 12,158,322 B2
(45) Date of Patent: Dec. 3, 2024

(54) RIGID ATTACHMENT SYSTEM

(71) Applicant: GBRS Group, Virginia Beach, VA (US)

(72) Inventors: Donald Wayne Shipley, III, Virginia Beach, VA (US); Blair Cole Fackler, Virginia Beach, VA (US); Slade William Cutrer, Virginia Beach, VA (US)

(73) Assignee: GBRS Group, Virginia Beach, VA (US)

( * ) Notice: Subject to any disclaimer, the term of this patent is extended or adjusted under 35 U.S.C. 154(b) by 371 days.

(21) Appl. No.: 17/497,822

(22) Filed: Oct. 8, 2021

(65) Prior Publication Data

US 2022/0316839 A1 Oct. 6, 2022

Related U.S. Application Data

(60) Provisional application No. 63/170,747, filed on Apr. 5, 2021.

(51) Int. Cl.
*A45F 3/14* (2006.01)
*F41C 33/04* (2006.01)

(52) U.S. Cl.
CPC ..... *F41C 33/046* (2013.01); *A45F 3/14* (2013.01); *A45F 2003/144* (2013.01)

(58) Field of Classification Search
CPC ..... A45F 2003/144; A45F 5/051; A45F 5/00; A45F 3/14; A45F 3/005; A45F 2200/0591; A45F 2200/0575; F41C 33/046; F41C 33/041
See application file for complete search history.

(56) References Cited

U.S. PATENT DOCUMENTS

| | | | | |
|---|---|---|---|---|
| 8,474,673 | B2 * | 7/2013 | Murdoch | A45F 5/021 224/675 |
| 8,510,868 | B2 * | 8/2013 | Mongan | A45F 5/021 224/195 |
| 9,339,102 | B2 * | 5/2016 | Iosilevich | A45F 3/14 |
| 11,470,950 | B2 * | 10/2022 | Hawkins | A45F 5/021 |
| 11,871,835 | B2 * | 1/2024 | Brown | A45F 3/005 |
| 2003/0110550 | A1 * | 6/2003 | Guibord | B25H 3/00 2/312 |

* cited by examiner

*Primary Examiner* — Corey N Skurdal

(74) *Attorney, Agent, or Firm* — Eversheds Sutherland (US) LLP

(57) ABSTRACT

A rigid attachment system is provided. The rigid attachment system may be, e.g., an assaulter belt assembly, which includes a first layer having a plurality of windows cut from a thermoplastic composite material, e.g., Tegris® or Curv®, the windows spaced apart along a length of the first layer and separated by a plurality of bridge portions. The assaulter belt assembly further includes a second layer extending along and coupled to a back side of the first layer forming a plurality of openings configured to support one or more accessory holders. A binding may be affixed over the upper and lower edges of the first layer via a horizontal stitching pattern, and the second layer may be affixed to first layer along the plurality of bridge portions via a vertical stitching pattern.

24 Claims, 10 Drawing Sheets

RIGID ATTACHMENT SYSTEM

Cross Reference to Related Applications

This application is a non-provisional of and claims the priority benefit of U.S. Application No. 63/170,747 filed Apr. 5, 2021, the entire contents of which are hereby incorporated by reference herein.

FIELD OF THE DISCLOSURE

The disclosure generally relates to a rigid attachment system, particularly an assaulter belt assembly and methods of manufacturing thereof.

BACKGROUND

Most "operator" or "gun" outer belts use multiple layers of rigid materials sewn together with a lightweight and pliable webbing material to attach equipment to, which results in an uncomfortable and overly thick belt. It is with respect to these and other considerations that the disclosure made herein is presented.

SUMMARY

Some or all of the above needs and/or problems may be addressed by certain embodiments of the rigid attachment system described herein. The rigid attachment system may be an assaulter belt assembly, which includes a first layer cut from a thermoplastic composite material/fabric, such as Tegris® (made available by Milliken Textiles, Spartanburg, South Carolina, USA) or Curv® (made available by Propex Furnishing Solutions GmbH & Co. KG, Westfalen, Germany), having a plurality of windows, the windows spaced apart along a length of the first layer and separated by a plurality of bridge portions. The assaulter belt assembly further may include a binding that is folded over the upper and lower edges of the first layer, and coupled to the first layer via horizontal stitching patterns along the length of the assaulter belt assembly. The binding may be a single binding that extends along the backside of the first layer and is folded over the upper and lower edges of the first layer, or alternatively, the binding may include a first binding that is folded over the upper edge of the first layer, and a second binding that is folded over the lower edge of the first layer. For example, when two bindings are used, each binding may be folded over the respective edge of the first layer without, or only slightly, obstructing the plurality of windows. Moreover, the assaulter belt assembly may include a second layer, e.g., a webbing, coupled to the first layer, the second layer extending along a back side (or inside) of the first layer. The second layer may be affixed to first layer, and accordingly the binding, via vertical stitching patterns along the bridge portions.

Other features and aspects of the rigid attachment system will be apparent or will become apparent to one with skill in the art upon examination of the following figures and the detailed description. All other features and aspects, as well as other system, method, and assembly embodiments, are intended to be included within the description and are intended to be within the scope of the accompanying claims.

BRIEF DESCRIPTION OF THE DRAWINGS

The detailed description is set forth with reference to the accompanying drawings. The use of the same reference numerals may indicate similar or identical items. Various embodiments may utilize elements and/or components other than those illustrated in the drawings, and some elements and/or components may not be present in various embodiments. Elements and/or components in the figures are not necessarily drawn to scale. Throughout this disclosure, depending on the context, singular and plural terminology may be used interchangeably.

DETAILED DESCRIPTION

Overview

Described below are embodiments of a rigid attachment system. For example, the rigid attachment system may be incorporated in an assaulter belt assembly, designed to fulfill the needs and requirements of, e.g., military, law enforcement, competitive shooters, and civilians that demand the most from their equipment. The assaulter belt assembly utilizes a two-layer outer belt to create a lightweight, flexible yet rigid and stable platform to attach equipment, holsters and accessories. This may be done by using, e.g., Type 13, 1-23/32" webbing as the base, with a field of Pouch Attachment Ladder System (PALS) webbing, laser cut from a semi rigid polymer, e.g., a thermoplastic composite, such as Tegris® or Curv®. In addition, a 1.75" Austrialpin Cobra buckle with a D-ring for attaching lanyards and other equipment may be utilized on the assaulter belt assembly. Moreover, a binding material may be sewn over the edges of the Tegris® material to clean up any rough edges, and further to aid in camouflage, e.g., prior to fixing the webbing layer to the thermoplastic composite layer.

In addition, a layer having an inner facing of "loop" fasteners, e.g., Velcro®, may be fixed to the backside of the webbing layer of the outer belt, such that the loop fasteners face toward the user's body, for releasably attaching to a low profile outer facing "hook" fasteners of an inner belt, worn directly by the user. The hook fasteners should not be worn towards the body, especially in a high wear area such as the beltline. A shroud/cover may be utilized to cover the inner belt when the outer belt is not in use. This results in an assembly that not only doubles as a non-metallic everyday carry (EDC) belt, but also a comfortable and convenient way to cover the scratchy "hook" portion of the inner belt. When the outer belt is needed, the inner belt shroud/cover may simply be removed, and the outer belt may be attached to the inner belt.

These and other embodiments of the disclosure will be described in more detail through reference to the accompanying drawings in the detailed description of the disclosure that follows. This brief introduction, including section titles and corresponding summaries, is provided for the reader's convenience and is not intended to limit the scope of the claims or the proceeding sections. Furthermore, the techniques described above and below may be implemented in a number of ways and in a number of contexts. Several example implementations and contexts are provided with reference to the following figures, as described below in more detail. However, the following implementations and contexts are but a few of many.

Illustrative Embodiments

Figure 1A:
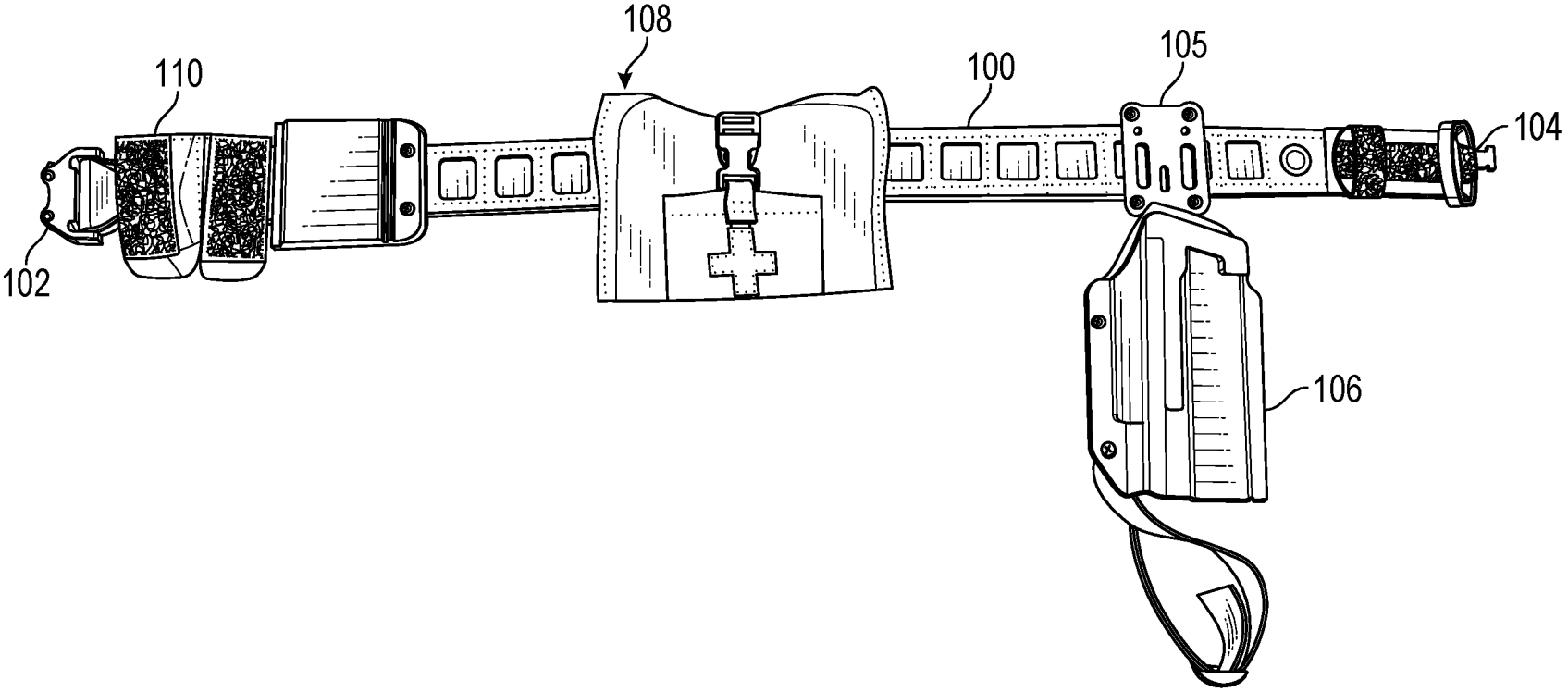
FIG. 1A illustrates an exemplary assaulter belt assembly constructed in accordance with one or more embodiments of the disclosure.
Figure 1B:
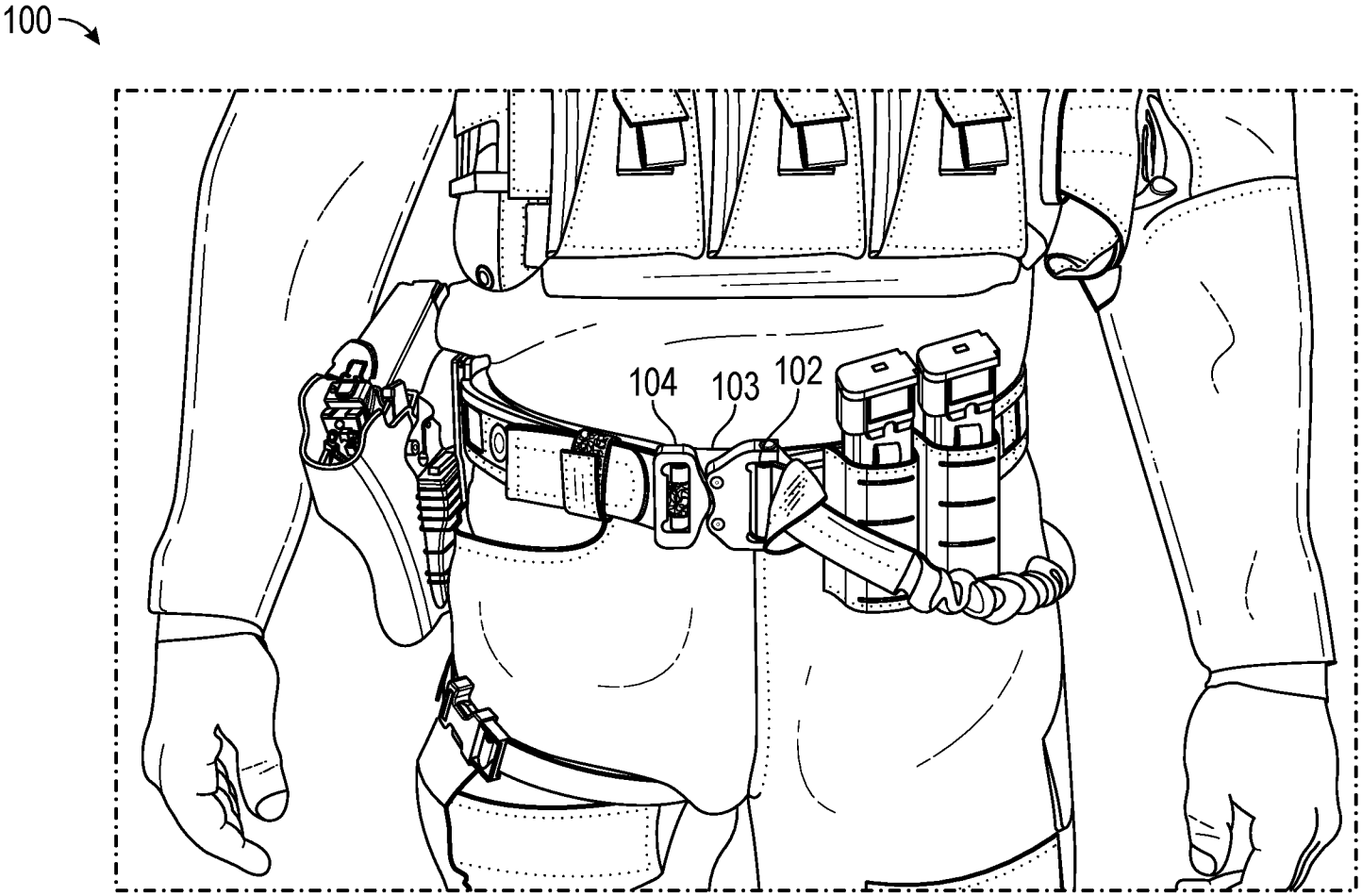
FIG. 1B illustrates the assaulter belt assembly of FIG. 1A worn on a human.

Referring now to FIGS. 1A and 1B, an exemplary assaulter belt assembly is provided. Assaulter belt assembly 100 is a lightweight, flexible yet rigid and stable platform to attach equipment, holsters and accessories, e.g., holster 106 via clip 105, first aid kit 108, and/or firearm accessory holder 110, e.g., a magazine pouch (or holder). Assaulter belt assembly 100 has first end 102 having a first coupling mechanism, and second end 104 having a second coupling mechanism configured to releasably couple to the first coupling mechanism. Accordingly, the wearer may wear assaulter belt assembly 100 around, e.g., their waist, and couple first and second coupling mechanisms to maintain assaulter belt assembly 100 in place. To take assaulter belt assembly 100 off, the wearer may decouple first and second coupling mechanisms. Moreover, first end 102 may include D-ring 103 for attaching, e.g., lanyards and other equipment.

Figure 2A:
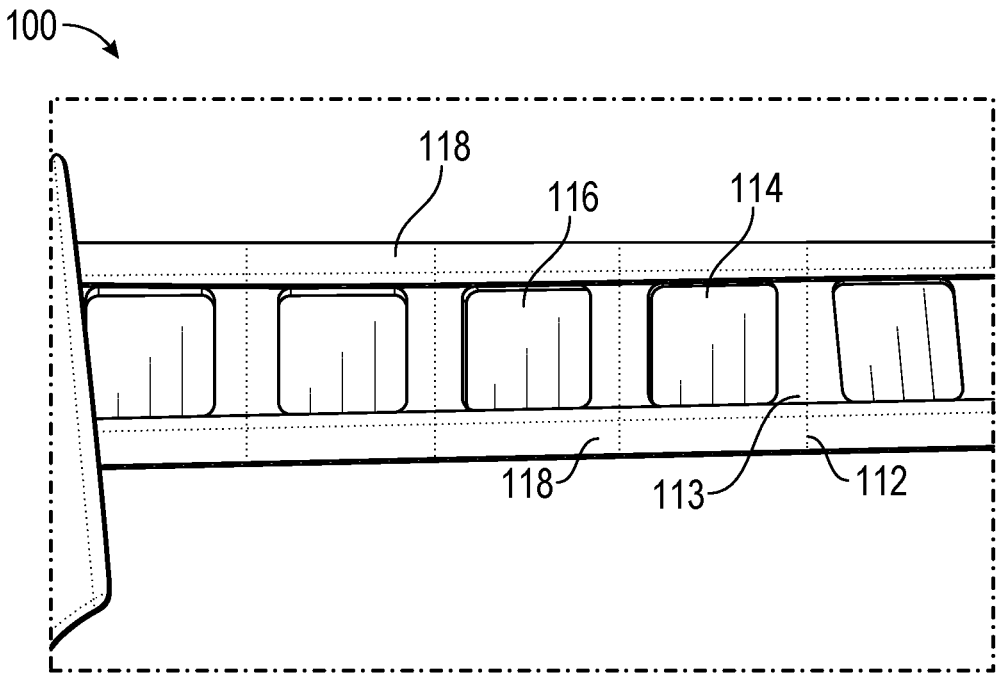
FIG. 2A is a close up view of the assaulter belt assembly of FIG. 1A.
Figure 2B:
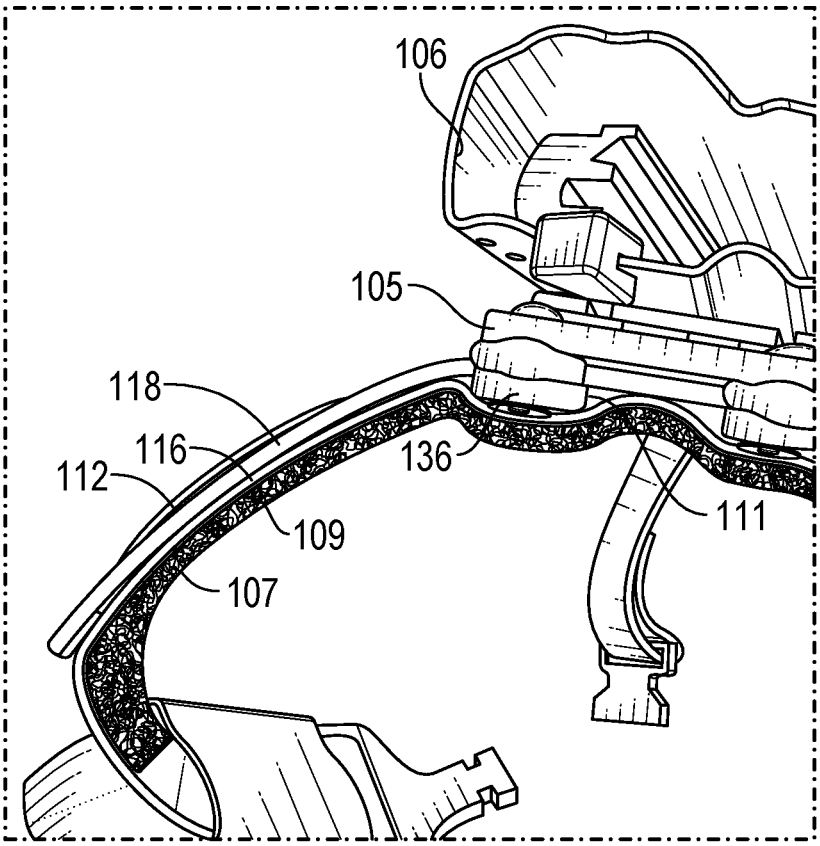
FIG. 2B is a top view of the assaulter belt assembly of FIG. 1A.
Figure 3:
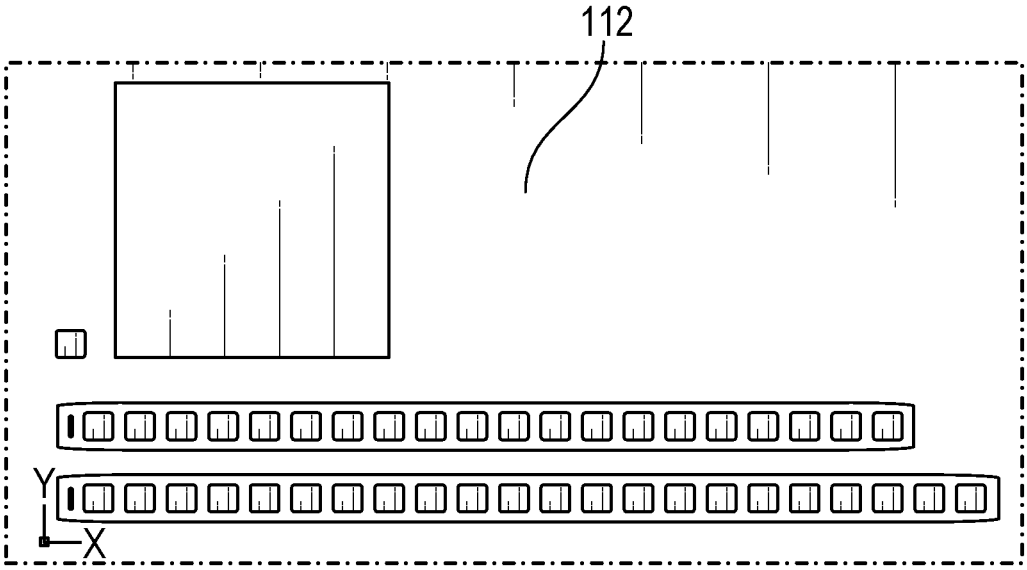
FIG. 3 illustrates DXF files for laser cutting the thermoplastic composite material to form the assaulter belt assembly in accordance with one or more embodiments of the disclosure.

Referring now to FIGS. 2A and 2B, the components of assaulter belt assembly 100 are described in further detail. As shown in FIG. 2A, assaulter belt assembly 100 may include first layer 112, second layer 116, and binding 118. First layer 112 may be formed of, e.g., a field of PALS webbing, laser cut from a semi rigid polymer, e.g., thermoplastic composite, such as Tegris®, Curv®, or a sheet of another thermoplastic. As shown in FIG. 2A, first layer 112 may be cut to form a plurality of windows 114 separated by a plurality of bridge portions 113. For example, first layer 112 may be laser cut from the thermoplastic composite material using DXF files, as shown in FIG. 3. FIG. 3 illustrates 1"×1" square and 10"×10" square for relative size validation.

Referring again to FIG. 2A, binding 118 may be sewn over the exposed upper and lower edges of first layer 112 to protect any rough edges of first layer 112 from contacting the wearer, as well as to aid in camouflage, e.g., using horizontal stitching patterns. Binding 118 may be a single binding that extends along the backside of first layer 112 and is folded over the upper and lower edges of first layer 112. Alternatively, and preferably, binding 118 includes a first binding that is folded over the upper edge of first layer 112, and a second binding that is folded over the lower edge of first layer 112. Accordingly, the first and second bindings may be sewn over the upper and lower edges of first layer 112 such that binding 118 does not, or only partially, cover windows 114. In some embodiments, windows 114 and bridges 113 may be of the same size along the length of assaulter belt assembly 100. Alternatively, windows 114 and bridges 113 may be of different sizes along the length of assaulter belt assembly 100 to provide various levels of flexibility. For example, smaller windows 114 and larger bridges 113 result in less flexibility, e.g., a stiffer belt. Moreover, windows 114 may appear in a regular or irregular pattern along the length of assaulter belt assembly 100, as would be the case if the window/bridge sizes were varied. Accordingly, the sizes of windows 114 and bridges 113 of assaulter belt assembly 100 may be selected to provide desired flexibility levels along the belt.

As will be understood by a person having ordinary skill in the art, first layer 112 cut from a thermoplastic composite, e.g., Tegris® or Curv®, having a pattern of windows 114 and bridges 113 along the length and width of first layer 112 may be used for other applications requiring a lightweight, flexible yet rigid and stable platform, other than an assaulter belt for supporting firearm accessories, as described in further detail below with regard to FIGS. 7A to 7D.

Figure 2C:
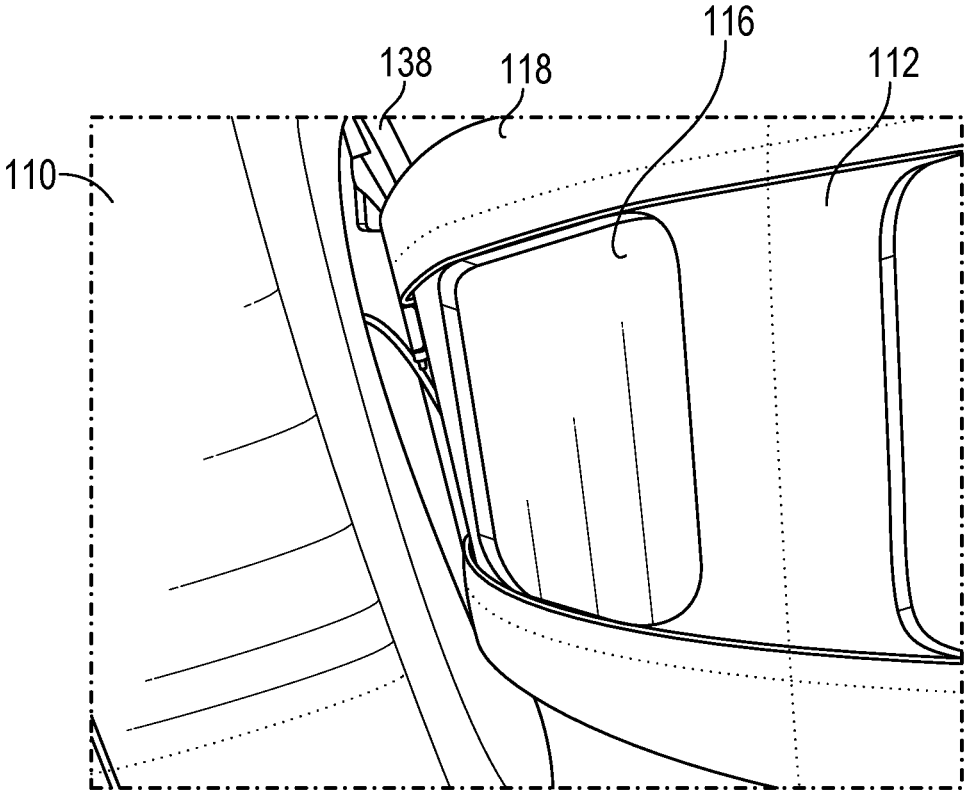
FIG. 2C illustrates coupling of a firearm accessory holder on the assaulter belt assembly in accordance with one or more embodiments of the disclosure.

Second layer 116 may be formed of, e.g., Type 13, 1-23/32" webbing. Second layer 116 may be positioned along the back side of first layer 112, and coupled to first layer 112, and accordingly binding 118, e.g., via vertical stitching patterns, as described in further detail below. As shown in FIG. 2B, second layer 116 is coupled to first layer 112 in a manner to form openings 111, e.g., along the upper edge of assaulter belt assembly 100. For example, second layer 116 may be sewn to first layer 112 via vertical stitching patterns along bridge 113, thereby forming openings 111 in between each adjacent bridge. Openings 111 are sized and shaped to receive engagement portions of various firearm accessory holders, to thereby support the firearm accessory holder. For example, as shown in FIG. 2B, holster 106 may include coupling plate 105 having engagement portions 136 sized and shaped to be received via openings 111. As shown in FIG. 2C, magazine pouch 110 may include engagement portion 138 sized and shaped to be received via openings 111.

In addition, assaulter belt assembly 100 may have a length, e.g., an adjustable length, sufficient to be worn by a wearer, e.g., a human. For example, an end of second layer 116 may be tightly looped through the second coupling mechanism for adjusting the length of assaulter belt assembly 100 depending on the waist size of the user. In some embodiments, assaulter belt assembly 100 may have a strap a predetermined distance from second end 104 for receiving the loose end of second layer 116.

Referring again to FIG. 2B, assaulter belt assembly 100 may include third layer 107 coupled to the back side of second layer 116. For example, third layer 107 may be coupled to second layer 116 via horizontal stitching patterns, and further may be coupled to second layer 116, first layer 112, and binding 118, via the vertical stitching patterns used to coupled first layer 112 to second layer 116. The back side of third layer 107 may include a layer of loop fasteners 109 for coupling to an inner belt, as described in further detail below. In addition, as binding 118 may be sewn over the upper edge of first layer 112, as shown in FIG. 2B, openings 111 may be formed at least partially between binding 118 and second layer 116.

Figure 4A:
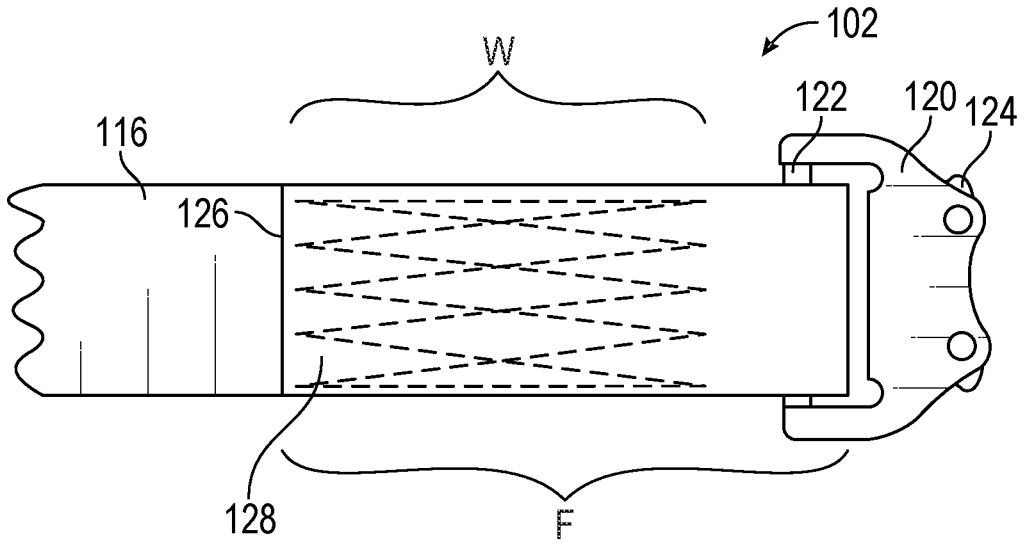
FIG. 4A illustrates an exemplary stitching pattern for the webbing of the assaulter belt assembly in accordance with one or more embodiments of the disclosure.

Referring now to FIGS. 4A to 4D, various stitching patterns for affixing first layer 112 and second layer 116 are provided. As shown in FIG. 4A, second layer 116 may be coupled to first coupling mechanism 120, e.g., a buckle having coupling mechanisms 124, at first end 102 of assaulter belt assembly 100. For example, second layer 116 may be passed through an opening of first coupling mechanism 120 formed by column 122, and affixed to itself, forming folded portion F, e.g., using a standard "double-W" stitching pattern 128 at stitching portion W. Preferably, stitching portion W remains 0.125" from the upper and lower edges of second layer 116, and is 4.0"+/−0.25" in length, and folded portion F is between 4.7" and 5.0" in length after implementing "double-W" stitching pattern W. To achieve this, second layer 116 may be marked, e.g., 5.25"+/−0.05" from end 126, such that the mark may be used as the center to create folded portion F. The fold may place edge 126 on the front face of assaulter belt assembly 100, e.g., away from the wearer's body, and edge 126 preferably is positioned behind bridge portion 113 of first layer 112 when second layer 116 is affixed to first layer 112, such that edge 126 is covered.

Figure 4B:
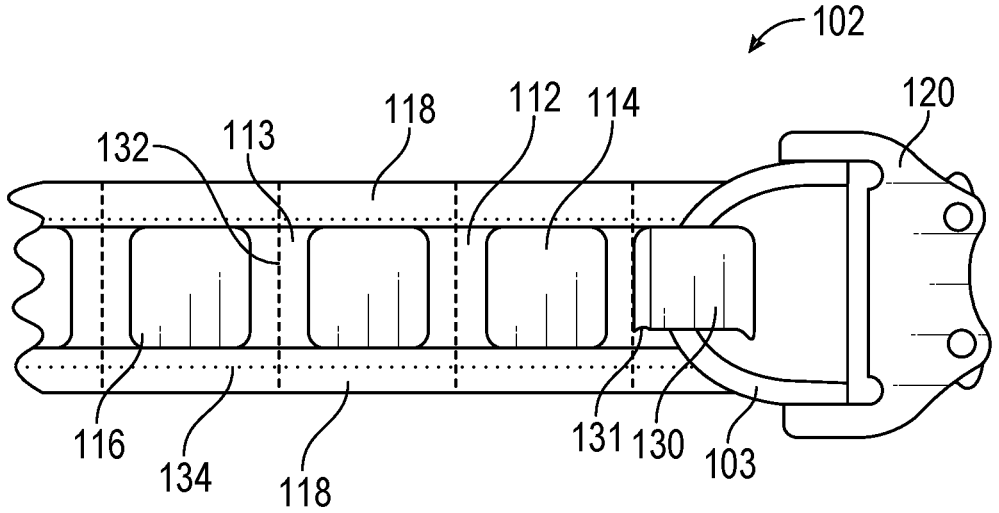
FIG. 4B illustrates exemplary stitching patterns for the webbing and the Tegris® material of the assaulter belt assembly in accordance with one or more embodiments of the disclosure.
Figure 4C:
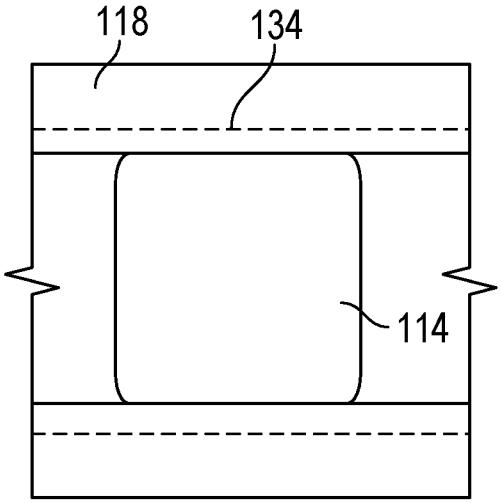
FIG. 4C is a close up view of an exemplary horizontal stitching pattern of the assaulter belt assembly in accordance with one or more embodiments of the disclosure.

As shown in FIG. 4B, binding 118 may be affixed to first layer 112 via horizontal stitching patterns 134 along the upper and lower edges of first layer 112, and second layer 116 and third layer 107 (not shown) may be affixed to first layer 112 and binding 118 via vertical stitching patterns 132 along bridge portions 113. For example, as shown in FIG. 4C, binding 118, e.g., ¾" binding, may be single-needle stitched to first layer 112, e.g., using horizontal stitching pattern 134, before tacking to the second layer 116. Binding 118 is stitched such that the fold is tight against the upper and lower edges of first layer 112. Preferably, the stitch line is 0.25"+/−0.02" from the folded edge, leaving 0.11"+/−0.02". Accordingly, the stitch may capture both sides of binding 118, thereby preventing the edge to lift up during normal use of assaulter belt assembly 100.

Referring again to FIG. 4B, first end 102 of assaulter belt assembly 100 may include flap 130 coupled to first layer 112 for securing D-ring 103. For example, first layer 112 may include narrow opening 130 sized and shaped to tightly receive flap 130 therethrough. Flap 130 may be passed through opening 130 and wrapped around the side edge of first layer 112 at first end 102, such that the opposing ends of flap 130 may be removably coupled to itself. For example, one side of flap 130 may include loop fasteners and the opposite side of flap 130 may include hook fasteners. Accordingly, flap 130 may be looped around D-ring 130 in addition to first layer 112 to thereby secure D-ring 130 in place.

Figure 4D:
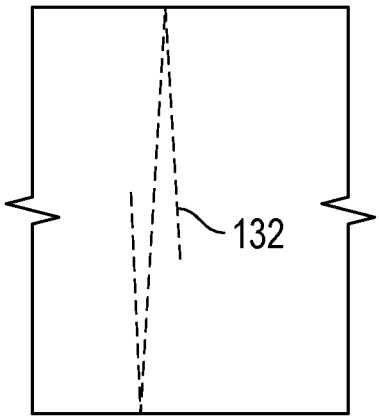
FIG. 4D is a close up view of an exemplary vertical stitching pattern of the assaulter belt assembly in accordance with one or more embodiments of the disclosure.

As shown in FIG. 4D, vertical stitching pattern 132, e.g., tacking, may start at a center region of bridge portion 113, travel towards an edge of first layer 112, e.g., the lower edge of first layer 112, travel toward the opposite edge of first layer 112, e.g., the upper edge of first layer 112, and travel back toward the center region of bridge portion 113. Preferably, the end point overlaps the initial point by at least three or four stitches. FIG. 4D illustrates the stitching laid side by side for visual purposes; however, in construction, vertical stitching pattern 132 is sewn in line on top of each other.

Figures 5A, 5B, 5C:
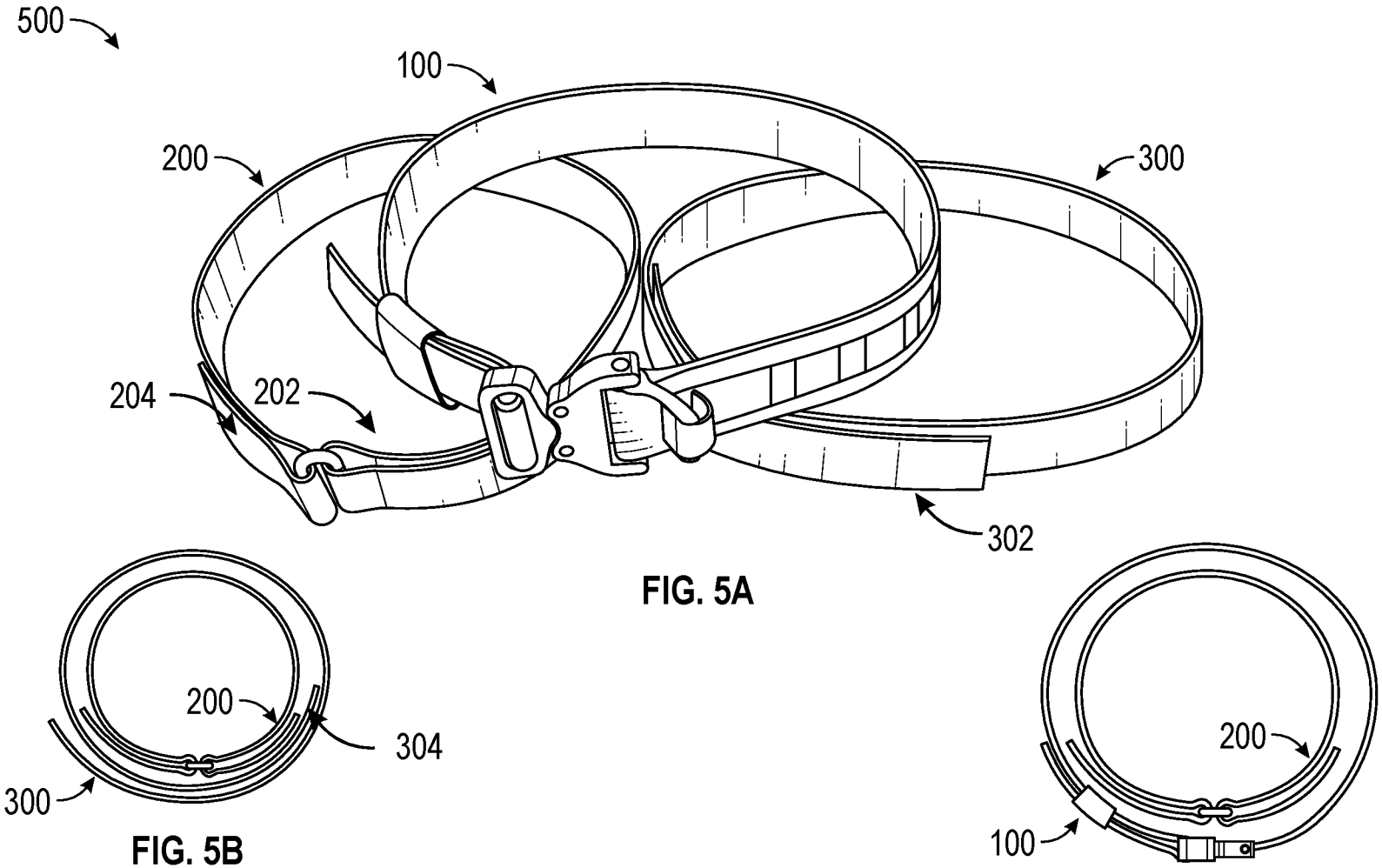
FIG. 5A is a view of additional components of the assaulter belt assembly in accordance with one or more embodiments of the disclosure.
FIG. 5B is a view of the inner belt and cover in accordance with one or more embodiments of the disclosure.
FIG. 5C is a view of the inner belt and assaulter belt assembly in accordance with one or more embodiments of the disclosure.

Referring now to FIGS. 5A to 5C, an assaulter belt system is described in further detail. As shown in FIG. 5A, assaulter belt system 500 may include inner belt 200, and optional cover 300, in addition to assaulter belt assembly 100. FIG. 5B illustrates cover 300 disposed on the front surface of inner belt 200, where the back surface of inner belt 200 is the side of inner belt 200 facing toward the wearer's body when worn, and the front surface of cover 300 is the side of cover 300 facing away from the wearer's body when worn. FIG. 5C illustrates the assaulter belt assembly 100 disposed on the front surface of inner belt 200, where the front surface of the inner belt 200 is the side of inner belt 200 facing away from the wearer's body when worn, and the back surface of assaulter belt system 100 is the side of the assaulter belt system 100 facing toward the wearer's body when worn.

As shown in FIG. 5A, inner belt 200 may include first end 202 having a receiver loop, and second end 204 which may be inserted through the receiver loop and folded back onto itself to secure second end 204 to first end 202. Inner belt 200 may be worn by the wearer, and may include a layer of hook fasteners, e.g., Velcro®, on its front surface, e.g., the side facing away from the wearer's body when worn. At least a portion of inner belt 200 along its length at second end 204 may have a layer of loop fasteners on its front surface and a layer of hook fasteners on its back side. Accordingly, when second end 204 is folded back onto itself through the receiver loop of first end 202, the layer of loop fasteners on its front surface will releasably engage with the layer of hook fasteners along the front surface of inner belt 200, such that the surface of second end 204 facing away from the wearer's body also may include a layer of hook fasteners. Accordingly, the layer of loop fasteners of third layer 107 of assaulter belt assembly 100 may be releasably engaged with the layer of hook fasteners of inner belt 200 when the wearer wears assaulter belt assembly 100.

When the wearer is not wearing assaulter belt assembly 100, cover 300 may be releasably engaged with inner belt 200, as shown in FIG. 5B. Accordingly, the back side of cover 300 may include a layer of loop fasteners. Thus, first end 302 of cover 300 may be attached to first end 202 of inner belt 200, and cover 300 may be wrapped around the wearer's waist and attached along the length of inner belt 200 as shown in FIG. 5B, until second end 304 of cover 300 sufficiently covers second end 204 of inner belt 200. At least a portion of second end 304 of cover 300 may overlap with first end 202 of inner belt 200 when worn.

Figure 6:
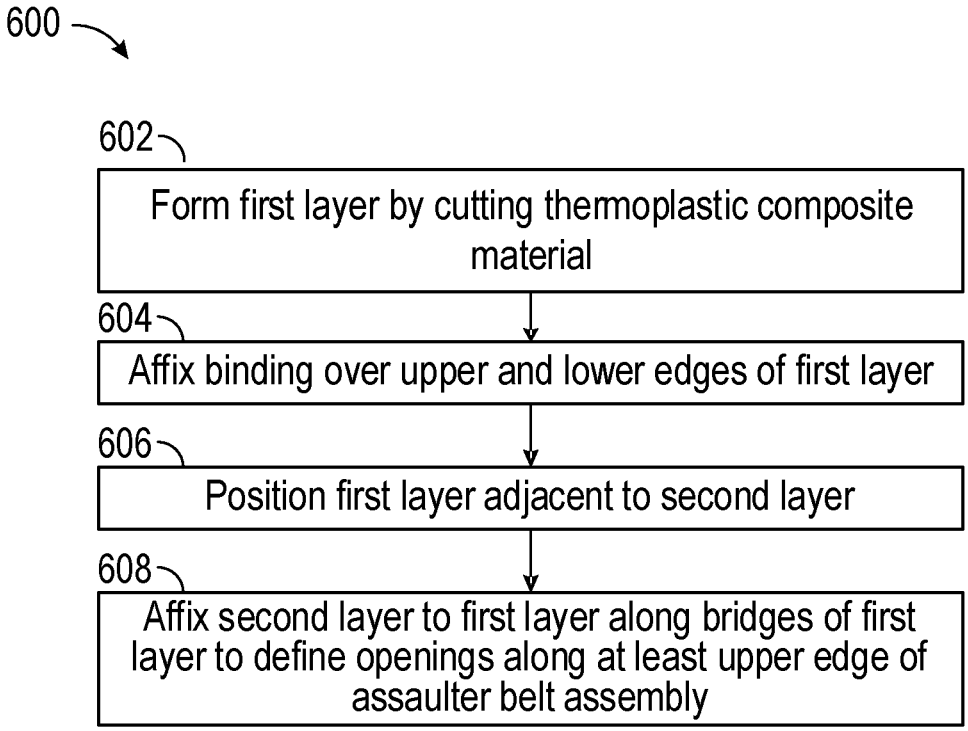
FIG. 6 is a flow chart illustrating the steps of an exemplary method for manufacturing the assaulter belt assembly in accordance with one or more embodiments of the disclosure.

Referring now to FIG. 6, method 600 for manufacturing assaulter belt assembly 100 is provided. At step 602, first layer 112 may be formed by layer cutting, e.g., squares, in a layer of thermoplastic composite material such as Tegris® or Curv® as described above, to form a plurality of windows. Alternatively, the plurality of windows may have other shapes such as rectangles, circles, diamonds, etc., or any combination thereof including squares. The shape of first layer 112 may be selected based on the desired use, e.g., as an assaulter belt as described above, or as other durable equipment such as a plate carrier, a cummerbund, a backpack, etc., as described in further detail below. When cutting first layer 112 to form assaulter belt assembly 100, the upper and lower edges of first layer 112 may be rough. Thus, at step 604, binding 118 may be affixed to the upper and lower edges of first layer 112 using horizontal stitching patterns 134 to cover any rough portions of the upper and lower edges of first layer 112.

At step 606, first layer 112 may be positioned adjacent to second layer 116. Third layer 107 also may be positioned adjacent to second layer 116. At step 608, second layer 116, and optionally third layer 107, may be affixed to first layer 122 and binding 118 using vertical stitching patterns 132 along bridge portions 113, thereby forming openings 111 along at least the upper edge of assaulter belt assembly 100. In some embodiments, the lower edge of assaulter belt assembly 100 also includes openings 111 formed by the fixation of first layer 122 and second layer 116.

Figure 7A:
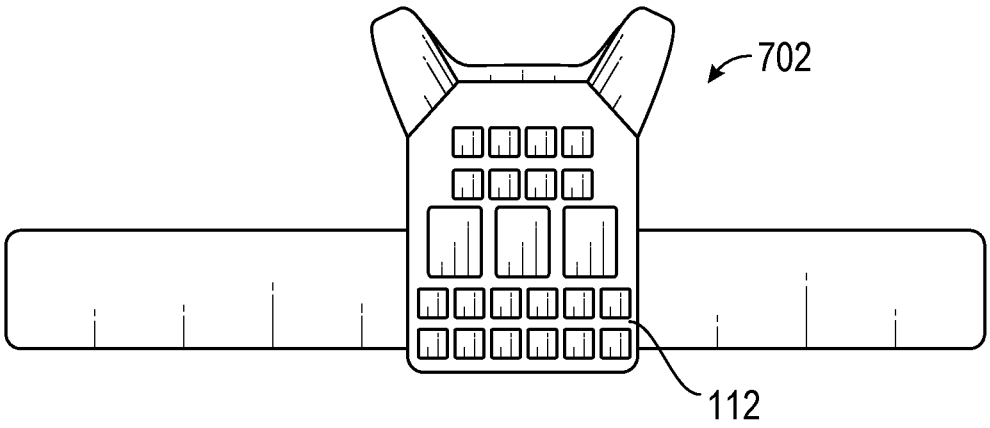
FIGS. 7A to 7D illustrate various alternative applications for the rigid attachment system constructed in accordance with one or more embodiments of the disclosure.
Figure 7B:
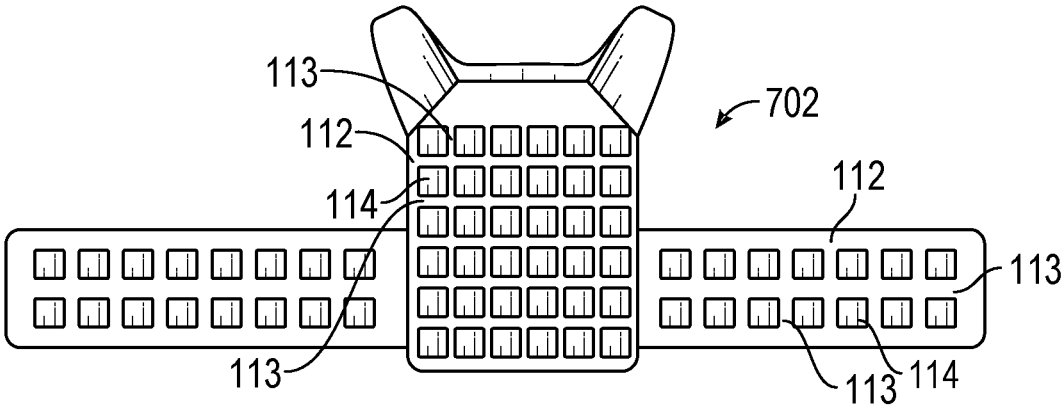

Referring now to FIGS. 7A to 7D, first layer 112 of the rigid attachment system described herein may be cut and used as an interface on other equipment including, but not limited to, a plate carrier, a cummerbund, a backpack, etc. Accordingly, first layer 112 may be cut from a semi rigid polymer, e.g., thermoplastic composite, such as Tegris® or Curv® or another thermoplastic having a pattern of windows 114 and bridges 113 along the length and height of first layer 112 depending on the application to provide a lightweight, flexible yet rigid and stable platform. For example, as shown in FIGS. 7A and 7B, plate carrier 702 may be formed of first layer 112. FIG. 7A illustrates a front side of plate carrier 702, and FIG. 7B illustrates a back side of plate carrier 702. As shown in FIG. 7B, first layer 112 may include multiple rows of windows 114 stacked vertically along the height of backpack 702, separated by a plurality of horizontal and vertical extending bridges 113, to form the back support portion of backpack 702. Moreover, the waist support portion of backpack 702 may be formed of first layer 112 having two rows of windows 114 separated by a plurality of horizontal and vertical extending bridges 113.

Figure 7C:
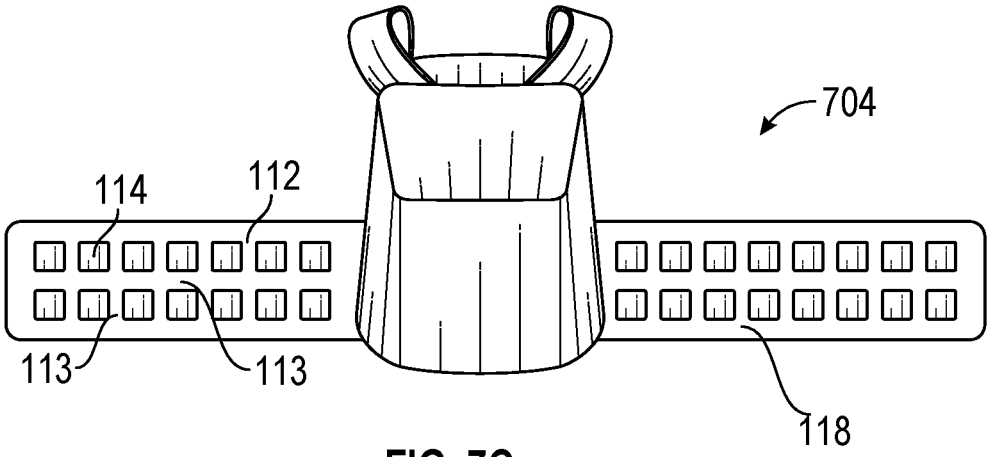
Figure 7D:
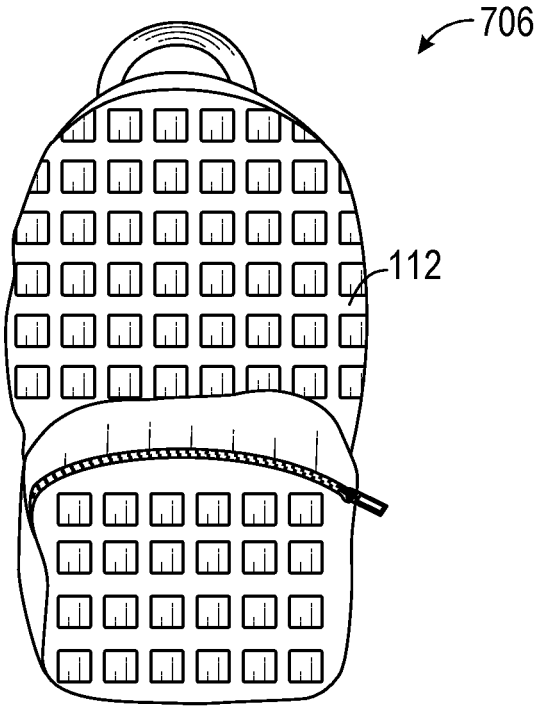

As shown in FIG. 7C, cummerbund 704 may be formed of first layer 112. As shown in FIG. 7C, first layer 112 may include two rows of windows 114 separated by a plurality of horizontal and vertical extending bridges 113. As shown in FIG. 7C, binding 118 may be affixed to the upper and lower edges of first layer 112 to cover any rough portions of the upper and lower edges of first layer 112, and additionally provide camouflage. In addition, binding 118 further may be affixed to first layer 112 along the middle of cummerbund 704, between the two rows of windows 114. As shown in FIG. 7D, backpack 706 may be formed of first layer 112.

Table 1 illustrated below includes exemplary bill of materials for a small/medium outer belt.

TABLE 1

| Part | Material | Color/Pattern | Length | Width | Quantity | Vendor |
|---|---|---|---|---|---|---|
| Thread | T70 Bonded Nylon Thread | Coyote 498 | | | | A&E |
| Belt Base | Type 13, 1 23/32" Webbing - Double Sided Print | Multicam | 49.75" | | 1 | MMI Textiles |
| Buckle | 1.75" D-Ring Cobra ProStyle Buckle | Anodized Matte Black with Black HPC Coating on D-Ring | | | 1 | AustriAlpin |
| Inside Loop | 1.5" Loop | Tan 499 | 32" | | 1 | Velcro |
| Face | Tegris - 12 layer | | 30.9" | 1.73" | 1 | Milliken Textiles |
| Binding | ¾" Single sided binding | Multicam | 32.5" | | 2 | MMI Textiles |
| Tail-end loop | 1" Printed Loop | Multicam | 11" | | 1 | MMI Textiles |
| D-ring Retainer | ¾" OneWrap | Tan 499 | 3.25" | | 1 | Velcro |
| Tail End Retainer | 1.5" OneWrap | Tan 499 | 6" | | 1 | Velcro |

Table 2 illustrated below includes exemplary bill of materials for a small/medium inner belt.

TABLE 2

| Part | Material | Color/Pattern | Length | Width | Quantity | Vendor |
|---|---|---|---|---|---|---|
| Thread | T70 Bonded Nylon Thread | Coyote 498 | | | | A&E |
| Belt Base | 1.5" Nylon Webbing, Double Side Print | Multicam | 50" | | 1 | MMI Textiles |
| Rec Ring | 1.5" Polymer Rectangular Ring | Tan 499 | | | 1 | ITW |
| Hook | 1.5" HTH Hook 745 | Tan 499 | 37" | | 1 | Velcro |
| Tail-end Loop | 1.5" Loop | Tan 499 | 6" | | 1 | Velcro |
| Tail End Hook | 1.5" HTH Hook 745 | Tan 499 | 10" | | 1 | Velcro |

Table 3 illustrated below includes exemplary bill of materials for a small/medium outer cover.

TABLE 3

| Part | Material | Color/Pattern | Length | Width | Quantity | Vendor |
|---|---|---|---|---|---|---|
| Thread | T70 Bonded Nylon Thread | Coyote 498 | | | | A&E |
| Belt Base | 1.5" Nylon Webbing, Double Side Print | Multicam | 47" | | 1 | MMI Textiles |
| Hook | 1.5" HTH Hook 745 | Tan 499 | 3" | | 1 | Velcro |
| Loop (inside) | 1.5" Loop | Tan 499 | 43" | | 1 | Velcro |
| Loop (outside) | 1.5" Loop | Multicam | 10" | | 1 | Velcro |

Table 4 illustrated below includes exemplary bill of materials for a large/extra-large outer belt.

TABLE 4

| Part | Material | Color/Pattern | Length | Width | Quantity | Vendor |
|---|---|---|---|---|---|---|
| Thread | T70 Bonded Nylon Thread | Coyote 498 | | | | A&E |
| Belt Base | Type 13, 1 23/32" Webbing - Double Sided Print | Multicam | 54.75" | | 1 | MMI Textiles |
| Buckle | 1.75" D-Ring Cobra ProStyle Buckle | Anodized Matte Black with Black HPC Coating on D-Ring | | | 1 | AustriAlpin |
| Inside Loop | 1.5" Loop | Tan 499 | 35" | | 1 | Velcro |
| Face | Tegris - 12 layer | | 33.9" | 1.73 | 1 | Milliken Textiles |
| Binding | ¾" Single sided binding | Multicam | 35.5" | | 2 | MMI Textiles |
| Tail-end loop | 1" Printed Loop | Multicam | 13.75" | | 1 | MMI Textiles |
| D-ring Retainer | ¾" OneWrap | Tan 499 | 3.25" | | 1 | Velcro |
| Tail End Retainer | 1.5" OneWrap | Tan 499 | 6" | | 1 | Velcro |

Table 5 illustrated below includes exemplary bill of materials for a large/extra-large inner belt.

TABLE 5

| Part | Material | Color/Pattern | Length | Width | Quantity | Vendor |
|---|---|---|---|---|---|---|
| Thread | T70 Bonded Nylon Thread | Coyote 498 | | | | A&E |
| Belt Base | 1.5" Nylon Webbing, Double Side Print | Multicam | 53" | | 1 | MMI Textiles |
| Rec Ring | 1.5" Polymer Rectangular Ring | Tan 499 | | | 1 | ITW |
| Hook | 1.5" HTH Hook 745 | Tan 499 | 40" | | 1 | Velcro |
| Tail-end Loop | 1.5" Loop | Tan 499 | 6" | | 1 | Velcro |
| Tail End Hook | 1.5" HTH Hook 745 | Tan 499 | 10" | | 1 | Velcro |

Table 6 illustrated below includes exemplary bill of materials for a large/extra-large outer cover.

TABLE 6

| Part | Material | Color/Pattern | Length | Width | Quantity | Vendor |
|---|---|---|---|---|---|---|
| Thread | T70 Bonded Nylon Thread | Coyote 498 | | | | A&E |
| Belt Base | 1.5" Nylon Webbing, Double Side Print | Multicam | 51" | | 1 | MMI Textiles |
| Hook | 1.5" HTH Hook 745 | Tan 499 | 3" | | 1 | Velcro |
| Loop (inside) | 1.5" Loop | Tan 499 | 47" | | 1 | Velcro |
| Loop (outside) | 1.5" Loop | Multicam | 10" | | 1 | Velcro |

The measurements listed above on the bill of materials are raw cuts and may not correspond to finished size when sewn, due to shrinkage under tension and variances in machine settings. Sample and/or test cuts of the thermoplastic composite material, such as Tegris® or Curv® should be made and verified in order to achieve a clean cut without overmelting. Preferably, samples are made with a single needle machine without any jigs or clamps. Running double and triple needle machines may be preferable. Care should be taken to not stitch through the thermoplastic composite material more often than is needed as extra needle holes weaken the structure of the thermoplastic composite material. Preferably, stitching is 8 SPI throughout, with even tension and uniform appearance. Moreover, bartacks should not be used on the thermoplastic composite material due to the increased number of needle holes. In addition, single needle binding on the thermoplastic composite material as the close proximity of the two needle lines may create a weak point. An HTH 747 Hook may be sewn with or without a centerline; however, care should be taken to not overstitch as it may create a tendency to tear along the "dotted line" of the stitch holes.

Although specific embodiments of the disclosure have been described, numerous other modifications and alternative embodiments are within the scope of the disclosure. For example, any of the functionality described with respect to a particular device or component may be performed by another device or component. Further, while specific device characteristics have been described, embodiments of the disclosure may relate to numerous other device characteristics. Further, although embodiments have been described in language specific to structural features and/or methodological acts, it is to be understood that the disclosure is not necessarily limited to the specific features or acts described. Rather, the specific features and acts are disclosed as illustrative forms of implementing the embodiments. Conditional language, such as, among others, "can," "could," "might," or "may," unless specifically stated otherwise, or otherwise understood within the context as used, is generally intended to convey that certain embodiments could include, while other embodiments may not include, certain features, elements, and/or steps. Thus, such conditional language is not generally intended to imply that features, elements, and/or steps are in any way required for one or more embodiments.

That which is claimed is:

1. An assaulter belt assembly configured to be worn by a human, the assembly comprising:

a first layer comprising a thermoplastic composite material and a plurality of windows spaced apart along a length of the first layer, the plurality of windows separated by a plurality of bridge portions;

a first binding folded over an upper edge of the first layer and coupled to the first layer;

a second layer extending along a back side of the first layer and coupled to the first layer; and a plurality of openings along at least an upper end of the assaulter belt assembly, the plurality of openings configured to support one or more accessory holders.

2. The assembly of claim 1, wherein the first layer comprises a Pouch Attachment Ladder System webbing pattern.

3. The assembly of claim 1, wherein at least one of the one or more accessory holders comprises at least one of a first aid kit, a firearm holster, or a magazine holder.

4. The assembly of claim 1, further comprising:

a first coupling mechanism coupled to a first end of the assaulter belt assembly; and a second coupling mechanism coupled to a second end of the assaulter belt assembly, the second coupling mechanism configured to releasably engage with the first coupling mechanism.

5. The assembly of claim 4, wherein an end region of the second layer is configured to fold through an opening of the first coupling mechanism and coupled to itself to fix the second layer to the first coupling mechanism.

6. The assembly of claim 5, wherein the second layer is coupled to itself via a double-W stitching pattern.

7. The assembly of claim 4, wherein the first coupling mechanism comprises a D-ring.

8. The assembly of claim 7, further comprising a flap coupled to the first layer adjacent to the D-ring, the flap configured to secure the D-ring.

9. The assembly of claim 1, wherein the second layer is coupled to the first layer via a vertical stitching pattern along the plurality of bridge portions.

10. The assembly of claim 9, wherein the vertical stitching pattern comprises stitching that begins in a center region of each of the plurality of bridge portions, and travels toward the upper edge of the first layer, toward the lower edge of the first layer, and back toward the center region.

11. The assembly of claim 1, further comprising a third layer coupled to a back side of the second layer, a back side of the third layer comprising a plurality of loop fasteners.

12. The assembly of claim 11, further comprising an inner belt assembly configured to be worn by the human, a front side of the inner belt assembly comprising a plurality of hook fasteners configured to be releasably engaged with the plurality of loop fasteners of the third layer.

13. The assembly of claim 12, further comprising a cover comprising a plurality of loop fasteners, the cover configured to be coupled to the inner belt assembly via the plurality of loop fasteners of the cover and the plurality of hook fasteners of the inner belt assembly when the third layer of the assaulter belt assembly is not engaged with the inner belt assembly.

14. The assembly of claim 1, wherein the second layer is coupled to the first layer to form the plurality of openings along at least the upper end of the assaulter belt assembly.

15. The assembly of claim 1, wherein the plurality of openings is formed at least in part by the first binding.

16. The assembly of claim 1, further comprising a second binding folded over a lower edge of the first layer and coupled to the first layer.

17. The assembly of claim 16, wherein the first and second bindings are coupled to the first layer via a single-needle stitching pattern.

18. The assembly of claim 17, wherein the single-needle stitching pattern captures both layers of the first and second bindings and the first layer.

19. A method for manufacturing an assaulter belt assembly, the method comprising:

forming a first layer by cutting a thermoplastic composite material to form a plurality of windows spaced apart along a length of the first layer, the plurality of windows separated by a plurality of bridge portions;

folding a first binding along an upper edge of the first layer and affixing the first binding to the first layer;

affixing a second layer to a backside of the first layer along the plurality of bridge portions; and forming a plurality of openings along at least an upper end of the assaulter belt assembly, the plurality of openings configured to support one or more accessory holders.

20. The method of claim 19, wherein the first layer comprises a Pouch Attachment Ladder System webbing pattern.

21. The method of claim 19, wherein affixing the first binding to the first layer and affixing the second binding to the second layer comprises using a single-needle stitching pattern.

22. The method of claim 19, wherein affixing the second layer to the first layer along the plurality of bridge portions comprises stitching from a center region of each of the plurality of bridge portions, toward the upper edge of the first layer, toward the lower edge of the first layer, and back toward the center region.

23. The method of claim 19, further comprising coupling a third layer to a back side of the second layer, a back side of the third layer comprising a plurality of loop fasteners.

24. The method of claim 19, further comprising folding a second binding along a lower edge of the first layer and affixing the second binding to the first layer.

* * * * *